United States Patent [19]

Hehmann

[11] 4,130,175

[45] Dec. 19, 1978

[54] FLUID-IMPERVIOUS ACOUSTIC SUPPRESSION PANEL

[75] Inventor: Horst W. W. Hehmann, Cincinnati, Ohio

[73] Assignee: General Electric Company, Cincinnati, Ohio

[21] Appl. No.: 779,776

[22] Filed: Mar. 21, 1977

[51] Int. Cl.[2] ..... G10K 11/04

[52] U.S. Cl. ..... 181/290; 181/291

[58] Field of Search ..... 181/284, 290, 291, 292; 428/138

[56] References Cited

U.S. PATENT DOCUMENTS

| | | | |
|---|---|---|---|
| 2,271,929 | 2/1942 | Venzie | 181/284 X |
| 2,326,763 | 8/1943 | Crandell | 428/138 |
| 2,826,261 | 3/1958 | Eckel | 181/290 |
| 3,770,560 | 11/1973 | Elder | 181/286 |
| 3,948,347 | 4/1976 | Rutledge | 181/291 |

FOREIGN PATENT DOCUMENTS

| | | | |
|---|---|---|---|
| 222770 | 9/1958 | Australia | 181/292 |
| 863611 | 3/1961 | United Kingdom | 181/290 |
| 963632 | 7/1964 | United Kingdom | 181/291 |

OTHER PUBLICATIONS

"Study and Tests to Reduce Compressor Sounds of Jet Aircraft", Technical Report DS-68-7, pp. II-61, II-62, II-212.

*Primary Examiner*—N. P. Godici

*Attorney, Agent, or Firm*—Robert C. Lampe, Jr.; Derek P. Lawrence

[57] ABSTRACT

An acoustic suppression panel is provided with a perforated plate covering a layer of a bulk absorber. A flexible, fluid-impervious membrane is placed between the plate and the bulk absorber, and supported in a manner so as to permit the membrane to become essentially acoustically transparent. An acoustically hard backing plate is disposed adjacent the bulk absorber, the backing plate being provided with perforations to allow pressure equalization for flight applications. A facing sheet of sintered metal covers the perforated plate to provide an aerodynamically continuous flow surface for the plate which is highly resistant to foreign object impact.

8 Claims, 2 Drawing Figures

FLUID-IMPERVIOUS ACOUSTIC SUPPRESSION PANEL

BACKGROUND OF THE INVENTION

This invention relates to an acoustic treatment suppression panel and, more particularly, to an acoustic treatment suppression panel which permits the use of bulk absorbers in an aircraft gas turbine engine environment.

Bulk absorbers have been widely recognized as being acoustically superior to other types of acoustic absorbers in certain applications, such as in the inlets of gas turbofan engines wherein it is desired to suppress turbomachinery-generated noise. In particular, bulk absorbers have been demonstrated to possess a wider suppression band width than typical single degree of freedom systems. Furthermore, the resistance of bulk absorbers tends to be linear with frequency and amplitude, whereas the single degree of freedom systems are nonlinear. However, the adaptation of bulk absorbers to aircraft gas turbine engine applications has been unsuccessful due to their inherent tendency to absorb fluids as well as noise. Fluid contaminants such as water, fuel and solvents are typically present in the gas turbine engine environments to which acoustically treated engine surfaces are exposed. This fluid produces problems such as system weight increase due to fluid absorption, potential structural damage due to fire and freezing and detrimental effects on the acoustic properties of the bulk absorber system.

Previous attempts to adapt bulk absorbers to the gas turbine engine environment have taken two approaches. In certain instances, attempts have been made to treat the relatively porous bulk absorber with a fluid repellant such as a fluorocarbon without significantly changing its acoustic properties. While this attempt has enjoyed limited success in excluding contamination by water absorption, it is unlikely that a universal repellant will be found which will be effective for the wide spectrum of fluids and gases encountered during jet engine operation. In other instances, attempts have been made to fabricate the mechanical equivalent to the acoustic behavior of a bulk absorber. An example of a multiple degree of freedom system exhibiting such behavior may be found in U.S. Pat. No. 3,819,009 - Motsinger, which is assigned to the same assignee as the present invention. However, generally speaking, multiple degree of freedom systems are costly and can only approach the acoustic behavior of a bulk absorber as the number of degrees of freedom, or intersticial partitions, becomes very large. Thus, it becomes desirable to provide an acoustic treatment suppression system which can take advantage of the acoustic properties of typical bulk absorbers while avoiding the problems associated with the contamination of fluids.

SUMMARY OF THE INVENTION

Accordingly, it is the primary object of the present invention to provide an acoustic suppression panel which utilizes a bulk absorber but which is impervious to contaminating fluids normally present in an aircraft engine environment.

It is another object of the present invention to provide an acoustic suppression panel utilizing a bulk absorber and which is resistant to foreign object impact.

These and other objects and advantages will be more clearly understood from the following detailed description, drawings and specific examples, all of which are intended to be typical of rather than in any way limiting on the scope of the present invention.

Briefly stated, the above objectives are accomplished in an acoustic suppression panel including a perforated plate covering a layer of fibrous bulk absorber. A flexible, fluid-impervious membrane is placed between the perforated plate and the bulk absorber, and is separated from the bulk absorber by spacers which permit the membrane to become essentially acoustically transparent and to move or vibrate. The fibrous bulk absorber is retained by a screen which provides further separation between the bulk absorber and the membrane. To allow for pressure equalization during flight conditions, an acoustically hard backing plate is provided with perforations to allow pressure equalization without destroying the acoustic properties of the panel. A facing sheet of sintered metal, for example, covers the perforated plate and provides an aerodynamically continuous flow surface for the panel which is highly resistant to foreign impact. Preferably, the effective acoustic resistance of the combination comprising the perforated plate and the facing sheet should be less than or equal to that of the combination comprising the bulk absorber and flexible membrane.

BRIEF DESCRIPTION OF THE DRAWINGS

While the specification concludes with claims particularly pointing out and distinctly claiming the subject matter which is regarded as part of the present invention, it is believed that the invention will be more fully understood from the following description of the preferred embodiment which is given by way of example with the accompanying drawings, in which:

DESCRIPTION OF THE PREFERRED EMBODIMENT

Figure 1:
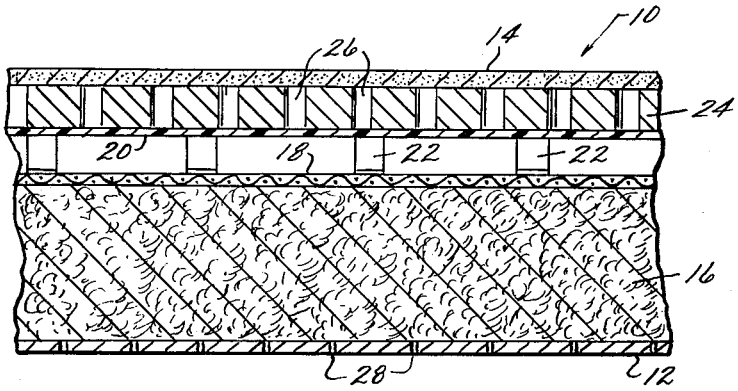
FIG. 1 is a schematic, cross-sectional view of an acoustic suppression panel constructed in accordance with the present invention.
Figure 2:
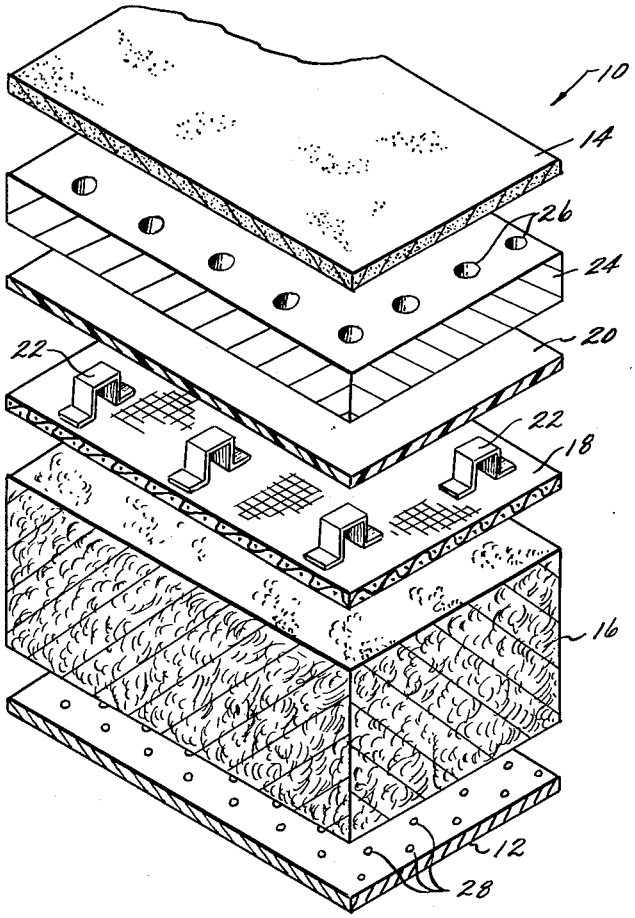
FIG. 2 is an exploded view of the acoustic panel of FIG. 1 depicting the subject invention in greater detail.

Referring to the drawings wherein like numerals correspond to like elements throughout, attention is directed to FIGS. 1 and 2 wherein a portion of an acoustic suppression panel indicated generally at 10 and fabricated in accordance with the present invention is depicted in cross-sectional and exploded views, respectively. Therein, the panel is shown to be of the multilayer type having an acoustically had backing plate 12 and a facing sheet 14 which may also comprise the lining of a fluid flow duct. A layer of a bulk absorber 16 is placed upon the backing plate, the depth of the absorber being a function of the tuning frequency which it is desired to suppress. Typical examples of commercially available bulk absorbers, which are given by way of example only, are the trademark products Kevlar, and Scottfelt 3-900. Clearly, other bulk absorber materials may be used, and preferably they will have a real impedance component of between approximately 20 and 90 CGS rayls above the design frequency of the material when installed.

The bulk absorber, which can be of the fibrous type, is retained by a relatively porous screen 18 which holds the bulk absorber in position against the backing plate without significantly affecting its acoustic properties.

Fluids are prevented from reaching the bulk absorber by means of a thin, flexible, fluid-impervious membrane 20 which is spaced from the bulk absorber and screen by means such as, for example, spacer 22. It has been shown that a 1-mil thick Mylar membrane separated from such a bulk absorber does not change its acoustic suppression characteristics significantly (reference "Study and Tests To Reduce Compressor Sounds In Jet Aircraft," FAA Report FAA-DS-68-7 dated Feb. 1968, page II-212). However, the membrane 20 must be supported in a manner so as to permit the membrane to become essentially acoustically transparent and to move or vibrate under the influence of acoustic waves. Thus, the need for spacers 22. Additionally, a perforated plate 24 behind facing sheet 14 has a very high porosity (greater than 20% open area as represented by holes 26) and further permits the flexible membrane 20 to become acoustically transparent. With such a high porosity, the perforated plate will not significantly affect the absorption coefficients of the bulk absorber.

Facing sheet 14, which may be of a porous sintered metal, covers holes 26 to provide foreign object protection and a first moisture barrier for the flexible membrane. Preferably, the combination of the sintered metal and perforated plate should have an effective acoustic resistance of between essentially 10 and 50 CGS rayls for gas turbine engine applications. The reason for this limitation is that the combination of a bulk absorber and flexible membrane would typically possess an effective acoustic resistance of less than or approximately equal to that of free air (42 CGS rayls) considering the inlet duct height and propagating modes. It is desirable to have the impedance of the facing less than or equal to that of the bulk absorber so that it does not act as a screening device, acoustically speaking. In essence, if foreign object damage was of little concern, a sintered metal layer 14 could be omitted and any perforated plate 24 used which had an impedance which was negligible compared to the bulk absorber (for example, a perforated plate having an open area ratio of greater than approximately 20%).

To allow for pressure equalization when the invention is adapted to aircraft applications, the acoustically hard backing plate 12 is perforated with a plurality of holes 28 having an open area of less than or approximately equal to one percent so that the acoustic properties of the material are not destroyed. As is well known, the bulk absorber requires a high resistance backing plate, and an open area of only one percent means that the plate looks like a hard plate at high frequencies, acoustically speaking.

Thus, in operation, a panel fabricated according to FIGS. 1 and 2 would possess positive means for excluding fluids from the bulk absorber without significantly changing its desirable acoustic properties. Facing sheet 14 could provide a lining for an acoustic duct, such as the inlet of a gas turbine engine, which is subject to a fluid contaminating environment. And, it will become obvious to one skilled in the art that certain changes can be made to the above-described invention without departing from the broad, inventive concepts thereof. For example, the spacers 22 could be of the large-cell honeycomb type, the screen 18 could be omitted in certain applications and, in certain other applications, it may be desirable to incorporate a plurality of spaced vertical partitions extending between the backing plate 12 and facing sheet 14 to make the panel locally reacting (i.e., impedes lateral acoustic wave propagation resulting from glancing acoustic wave energy which would destroy the effectiveness of the bulk absorber). In such a manner, glancing acoustic wave motion could be converted to perpendicular pumping motion within the cavitites so formed. It is intended that the appended claims cover these and all other variations in the present invention's broader inventive concepts.

Having this described the invention, what is claimed as novel and desired to be secured by Letters Patent of the United States is:

1. A multilayered acoustic suppression panel comprising:
   - a layer of a bulk absorber;
   - a flexible, fluid impermeable membrane covering said bulk absorber;
   - means for spacing said membrane from said bulk absorber to form a space therebetween so that said membrane can vibrate and be essentially acoustically transparent;
   - a perforated plate partially sandwiching said membrane, said plate having a porosity great enough to permit said membrane to be essentially acoustically transparent in the presence of acoustic waves; and
   - an acoustically hard backing sheet for said bulk absorber.

2. The panel as recited in claim 1 further comprising a porous screen disposed between said bulk absorber and said spacial maintaining means to further retain said bulk absorber in position.

3. The panel as recited in claim 1 wherein the effective acoustic resistance of said perforated plate is essentially within the range of 10 to 50 CGS rayls.

4. The panel as recited in claim 1 wherein the backing sheet is characterized as being perforated and as having an open area of no more than one percent.

5. The panel as recited in claim 1 further comprising a porous facing sheet covering said perforated plate and wherein the effective acoustic resistance of said facing sheet and plate is essentially within the range of 10 to 50 CGS rayls.

6. The panel as recited in claim 5 wherein said porous facing sheet comprises a sintered metal.

7. The panel as recited in claim 1 wherein said perforated plate is characterized as having an open area greater than essentially twenty percent.

8. A multilayered acoustic suppression panel comprising:
   - a layer of a fibrous bulk absorber sandwiched between a porous screen and an acoustically hard backing sheet;
   - a flexible, fluid-impermeable membrane disposed toward the screen side of said bulk absorber;
   - means for spacing said membrane from said screen to permit said membrane to be essentially acoustically transparent and vibrate in the presence of acoustic waves; and
   - a perforated plate in contact with said membrane and having a porosity great enough to further permit said membrane to be essentially acoustically transparent and vibrate in the presence of acoustic waves.

* * * * *